US008519816B2

(12) United States Patent
Takeda

(10) Patent No.: US 8,519,816 B2
(45) Date of Patent: Aug. 27, 2013

(54) EXTERNAL OPERATION THERMAL PROTECTOR

(75) Inventor: Hideaki Takeda, Saitama (JP)

(73) Assignee: Uchiya Thermostat Co., Ltd. (JP)

( * ) Notice: Subject to any disclaimer, the term of this patent is extended or adjusted under 35 U.S.C. 154(b) by 256 days.

(21) Appl. No.: 12/933,202

(22) PCT Filed: Dec. 16, 2008

(86) PCT No.: PCT/JP2008/003777

§ 371 (c)(1),
(2), (4) Date: Sep. 17, 2010

(87) PCT Pub. No.: WO2009/125458

PCT Pub. Date: Oct. 15, 2009

(65) Prior Publication Data

US 2011/0043321 A1 Feb. 24, 2011

(30) Foreign Application Priority Data

Apr. 10, 2008 (JP) ..... 2008-102657

(51) Int. Cl.
*H01C 7/13* (2006.01)
*H01H 37/52* (2006.01)
*H05B 1/02* (2006.01)

(52) U.S. Cl.
USPC ..... 337/398; 337/102; 337/343; 337/362; 337/377; 361/105

(58) Field of Classification Search
USPC ..... 361/103, 105; 337/102–104, 377, 337/342, 343, 398, 362
See application file for complete search history.

(56) References Cited

U.S. PATENT DOCUMENTS 3,223,808 A * 12/1965 Wehl ..... 337/360
3,443,259 A * 5/1969 Wehl et al. ..... 337/89

(Continued)

FOREIGN PATENT DOCUMENTS

CN 1162187 A 10/1997
DE 19636320 A1 * 3/1997

(Continued)

OTHER PUBLICATIONS

International Application Serial No. PCT/JP2008/003777, International Search Report mailed Mar. 24, 2009, 4 pgs.

(Continued)

*Primary Examiner* — Anatoly Vortman
(74) *Attorney, Agent, or Firm* — Schwegman Lundberg & Woessner, P.A.

(57) ABSTRACT

Embodiments relate to an external operation thermal protector incorporating a polymer PTC element that is operable in a safe state in which a hot spot does not occur even under volume expansion due to thermal expansion at the time of heat generation. A terminal plate of a resistance element module having a polymer PTC element is caulked above a column and fixed to a body casing together with the fixed end of a movable plate interlocked with a bimetal and a second terminal. Another terminal plate of the resistance element module is arranged with a gap, for absorbing the volume expansion caused when the polymer PTC element generates heat, with respect to the inner wall of the body casing. The current for an external load between a first terminal and the second terminal is interrupted by externally energizing the second terminal and a third terminal.

4 Claims, 4 Drawing Sheets

(56) References Cited

U.S. PATENT DOCUMENTS

| | | | | | |
|---|---|---|---|---|---|
| 3,840,834 | A | * | 10/1974 | Obenhaus et al. | 337/79 |
| 4,262,273 | A | * | 4/1981 | Grable | 337/67 |
| 4,319,126 | A | * | 3/1982 | Lujic | 219/512 |
| 4,563,667 | A | * | 1/1986 | Hofsass | 337/349 |
| 4,755,787 | A | * | 7/1988 | Wehl | 337/372 |
| 4,862,132 | A | * | 8/1989 | Hollweck | 337/102 |
| 4,878,038 | A | * | 10/1989 | Tsai | 337/107 |
| 4,894,634 | A | * | 1/1990 | Nezuka et al. | 337/343 |
| 5,103,202 | A | * | 4/1992 | Lennon et al. | 337/100 |
| 5,233,325 | A | * | 8/1993 | Takeda | 337/107 |
| 5,309,131 | A | * | 5/1994 | Hofsass et al. | 337/102 |
| 5,367,279 | A | * | 11/1994 | Sakai | 337/104 |
| 5,428,336 | A | * | 6/1995 | Smith et al. | 337/365 |
| 5,607,610 | A | * | 3/1997 | Furukawa | 219/505 |
| 5,621,376 | A | * | 4/1997 | Takeda | 337/372 |
| 5,757,262 | A | * | 5/1998 | Takeda | 337/380 |
| 5,804,798 | A | * | 9/1998 | Takeda | 219/511 |
| 5,847,637 | A | * | 12/1998 | Takeda et al. | 337/344 |
| 5,936,510 | A | * | 8/1999 | Wehl et al. | 337/377 |
| 5,973,587 | A | * | 10/1999 | Hofsass | 337/377 |
| 6,020,807 | A | * | 2/2000 | Givler | 337/377 |
| 6,031,447 | A | * | 2/2000 | Hofsass | 337/377 |
| 6,249,210 | B1 | * | 6/2001 | Hofsass | 337/324 |
| 6,265,961 | B1 | * | 7/2001 | Takeda | 337/333 |
| 6,300,858 | B1 | * | 10/2001 | Kalapodis et al. | 337/140 |
| 6,300,860 | B1 | * | 10/2001 | Hofsass | 337/377 |
| 6,346,796 | B1 | * | 2/2002 | Takeda | 320/154 |
| 6,396,381 | B1 | * | 5/2002 | Takeda | 337/377 |
| 6,414,285 | B1 | * | 7/2002 | Takeda | 219/507 |
| 6,633,222 | B2 | * | 10/2003 | Nagai et al. | 337/365 |
| 6,801,116 | B2 | * | 10/2004 | Oh et al. | 337/112 |
| 6,995,647 | B2 | * | 2/2006 | Stiekel | 337/112 |
| 7,330,097 | B2 | * | 2/2008 | Takeda | 337/102 |
| 7,632,373 | B2 | | 12/2009 | Galla | |
| 2006/0051588 | A1 | | 3/2006 | Galla | |
| 2013/0015944 | A1 | | 1/2013 | Takeda | |

FOREIGN PATENT DOCUMENTS

| | | | | |
|---|---|---|---|---|
| EP | 507425 | A1 | * | 10/1992 |
| JP | 51-69069 | U | | 6/1976 |
| JP | 06119859 | A | * | 4/1994 |
| JP | 9-204861 | A | | 8/1997 |
| JP | 2001-6510 | A | | 1/2001 |
| JP | 2002-204525 | A | | 7/2002 |
| JP | 2006-121049 | A | | 5/2006 |

OTHER PUBLICATIONS

Chinese Application Serial No. 200880128497.8, Office Action mailed Sep. 26, 2012, 4 pgs.

Japanese Application Serial No. 2010-507068, Office Action mailed Oct. 9, 2012, (w/ English Translation), 6 pgs.

* cited by examiner

EXTERNAL OPERATION THERMAL PROTECTOR

RELATED APPLICATIONS

This application is a U.S. National Stage Filing under 35 U.S.C. 371 from International Application No. PCT/JP2008/003777, filed on Dec. 16, 2008, and published as WO 2009/125458 A1 on Oct. 15, 2009, which claimed priority under U.S.C. 119 to Japanese Application No. 2008-102657, filed Apr. 10, 2008, which applications and publication are incorporated herein by reference in their entirety.

TECHNICAL FIELD

The present invention relates to a thermal protector for protection against an excess increase in the temperature of an electric appliance, etc., and more specifically to a thermal protector incorporating a polymer PTC element operable not only in an automatic operation but also in a forcible external operation, and also operable in a safe state in which a hot spot does not occur.

BACKGROUND ART

Conventionally, a number of protective elements in a power supply circuit have been automated recovering bimetallic protectors or non-automated recovering elements using a meltable element such as a temperature fuse, a current fuse, etc., and also a number of combinations of a fuse, a protector, and a heating resistor have been widely used.

When a resistor is a main component, it is built into a cement resistor, and when a fuse is a main component, a meltable element and a resistor are built into a plate which is implemented on a printed circuit for commercial use.

These protective elements are used in interrupting and detecting an abnormal current, and also in energizing a resistor and forcibly interrupting a current.

A protective device represented by a common protector is set to operate automatically through changes in temperature and current in order to avoid the possibility that a part melts and becomes disconnected due to overheating caused by an abnormal ambient temperature, an excess current flow, etc.

For example, the conditions are set for protection against overheating in a case in which a temperature of 150° C. or above is attained, which is hazardous, for protection against overloading in a case in which a current of 20 A or greater is to be interrupted, etc. If these abnormal situations are temporary occurrences it is necessary for a protector to be an automated recovering unit.

On the other hand, an automated recovering protective element can continuously enter a hazardous state or proceed toward a worse state due to a fault with an external factor to a power supply in a power supply circuit, for example, due to an overload, a short circuit, or overheating caused by insufficient radiation.

The reuse of a protective circuit may not be realized if a non-automated recovering protective element such as a conventional fuse is operated as a protector for a countermeasure against the above-mentioned fault. In this case, a manually reset protector or a self-sustaining protector can be used.

However, when such a hazardous state is detected, advanced countermeasures can be taken to ensure safe operation if the hazardous state can be avoided by intentionally operating a protective element via an electronic circuit and software.

It is all the more necessary for an expensive system to be protected and for higher reliability to be achieved in stopping a function before a fault in an internal part occurs, in avoiding a hazardous state, and in realizing reuse.

An external operation thermal protector is appropriate for restoring a system to a state in which reuse can be realized after confirmation of security of the system by avoiding a hazardous state of the system when a protective element is intentionally operated as described above.

Generally, a PTC (positive temperature coefficient) element is used as a heating resistor that is available as a protector. PTC elements are roughly classified into ceramic PTC elements and polymer PTC elements. Although ceramic PTC elements are expensive, they are stable in shape against thermal change. Therefore, they are easily incorporated into a protector body as a part.

Since ceramic PTC elements are stable in shape as heating resistors regardless of thermal change, the heating resistor can be fixed and incorporated by a strong upward and downward push to effectively use thermal conductivity when it is incorporated into the protector body.

For example, as with U.S. Pat. No. 3,825,583, a bimetallic protector obtained as a combination of a bimetal and a heating resistor is proposed as an example of a conventional operation thermal protector. With the protector, a PTC element is caulked and crimped for assembly. That is, a ceramic PTC element is assumed in this case.

On the other hand, since most thermal protectors for protection against an excessive increase in temperature in a circuit with a voltage equal to or lower than a commercial supply voltage have a small necessary amount of current and have low-price circuit configurations, it is advantageous to use polymer PTC elements, which operates with low resistance, rather than ceramic PTC elements, as the former are less expensive than the latter.

Polymer PTC elements are made by dispersing conductive particles, for example, carbon particles, on an insulating synthetic resin, and the principles of their current interruption abilities are well known. Even if a current passes through the conductive path formed through conductive particles at a normal temperature, it causes volume expansion due to thermal expansion around the melting point of a synthetic resin at a high temperature, thereby disconnecting the electrical connections between the conductive particles, suddenly raising the inner resistance, and greatly decreasing the current.

Volume expansion due to a thermal effect as described above is important for the current interrupt operation of the polymer PTC element. If the volume expansion is restricted or if compressive expansion occurs on the body of the polymer PTC element due to a strong pressure when the current is interrupted, then localized current concentration occurs and a hot spot is generated.

Therefore, incorporating the polymer PTC element into a protector is not as easy as incorporating the ceramic PTC element, which can be incorporated anywhere a fixing process can be performed.

DISCLOSURE OF INVENTION

The present invention has been developed to overcome the above-mentioned problems, and aims to provide a method of safely incorporating the polymer PTC element into a protector so that the volume expansion cannot be restricted, and to provide an external operation thermal protector which is small, safe recoverable, and easily operable by incorporating the polymer PTC element into the protector in the method.

To attain the above-mentioned objective, the external operation thermal protector according to the first embodiment, which interrupts an electric circuit using a bimetal element whose warping direction is inverted at a predetermined temperature in reaction to an ambient temperature, includes: a body casing; a fixed conductor having a fixed contact point at one end; a first terminal formed at an end of the fixed conductor for connection to an external circuit external to the body casing; a movable plate having a movable contact point at a position opposite the fixed contact point on a free end side, having a spring property for allowing the movable contact point to have a predetermined contact pressure at a contact point, being fixed to the body casing at an end opposite the free end side through an insulating member, and changing the position of the free end side via the inversion of the bimetal element; a second terminal connected to the movable plate for external connection; a resistance element module having a polymer PTC element provided with an inner resistance element and electrodes on both surfaces of the inner resistance element, first and second terminal plates soldered to the electrodes on both sides of the polymer PTC element, and first and second connection units laid together after being extended parallel to the electrode surfaces from the first and second terminal plates, wherein the first connection unit is connected to the second terminal at an end opposite the free end of the movable plate, and the first terminal plate is fixed to the body casing through the movable plate and the insulating member; and a third terminal formed by the second connection unit of the resistance element module for external connection external to the body casing. The second terminal plate is arranged with a gap for absorbing the volume expansion by heat generated by the polymer PTC element between the body casing and an inner wall. The trip temperature at which the resistance of the polymer PTC element suddenly changes is set higher than the inversion operation temperature of the bimetal element. When a current is led to the second and third terminals, the polymer PTC element forcibly enters the trip state, and heats and operates the bimetal element, thereby interrupting the current between the first and second terminals.

The external operation thermal protector heats the polymer PTC element at a predetermined temperature by maintaining the current to the second and third terminals after interrupting the current between the first and second terminals, and continuously maintains the current interrupt operation between the first and second terminals.

The external operation thermal protector also sets the trip temperature, at which the resistance of the polymer PTC element suddenly changes, to be lower than the operation temperature of the bimetal element, and passes a current to the second and third terminals to heat the bimetal element at a constant temperature when the polymer PTC element is forcibly placed in the trip state, thereby correcting the current and time for protection against overloading in the low temperature atmosphere for the interrupting operation, with the overcurrent passing between the first and second terminals.

Furthermore, the external operation thermal protector can also be configured to perform a self-sustaining operation when the interrupt operation is performed between the first and second terminals with overheating or overcurrent by additionally connecting the polymer PTC element parallel to the inner contact point circuit between the first and second terminals by connecting the first and third terminals externally to the body casing.

Next, the external operation thermal protector according to the second embodiment includes: a body casing, a bimetal element whose warping direction is inverted at a predetermined temperature in reaction to an ambient temperature; a movable plate engaged at both ends corresponding to the longitudinal direction of the body casing of the bimetal element, having a movable contact point on a free end side, having a spring property for allowing the movable contact point to have a predetermined contact pressure at a contact point, being fixed to the body casing at an end opposite the free end side through an insulating member, and changing the position of the free end side via the inversion of the bimetal element; a second terminal connected to the movable plate for external connection; a first resistance element module having a first polymer PTC element provided with an inner resistance element and electrodes on both surfaces of the inner resistance element, first and second terminal plates soldered to the electrodes on both sides of the first polymer PTC element, and first and second connection units laid together after being extended parallel to the electrode surfaces from the first and second terminal plates, wherein the first connection unit is connected to the second terminal at an end opposite the free end of the movable plate, and the first terminal plate is fixed to the body casing through the movable plate and the insulating member; a third terminal formed by the second connection unit of the first resistance element module for external connection external to the body casing; a second resistance element module having a second polymer PTC element provided with an inner resistance element and electrodes on both surfaces of the inner resistance element, third and fourth terminal plates soldered to the electrodes on both sides of the second polymer PTC element, and third and fourth connection units laid together after being extended parallel to the electrode surfaces from the third and fourth terminal plates, wherein the third connection unit is connected to the second terminal at an end opposite the free end of the movable plate, and the third terminal plate is fixed to the body casing through the movable plate and the insulating member; a fixed contact point formed at a position corresponding to the movable contact point inside the body casing on the fourth connection unit of the second resistance element module; and a third terminal formed by a portion extended from the position in which the fixed contact point of the fourth connection unit is formed for external connection external to the body casing. The second terminal plate is arranged with a gap for absorbing the volume expansion by heat generated by the first polymer PTC element between the body casing and an inner wall. The fourth terminal plate is arranged with a gap absorbing the volume expansion by heat generated by the second polymer PTC element between the inner wall opposite the inner wall of the body casing. The trip temperature at which the resistance of the first polymer PTC element suddenly changes is set to be higher than the inversion operation temperature of the bimetal element. The trip temperature at which the resistance of the second polymer PTC element suddenly changes is set to be higher than the recovery temperature of the bimetal element. When a current is led to the second and third terminals, the first polymer PTC element forcibly enters the trip state, and heats and operates the bimetal element, thereby interrupting the current between the first and second terminals. After the current is interrupted, the recovery of the bimetal element is interrupted at the heating temperature of the second polymer PTC element, thereby maintaining the interrupted state.

The external operation thermal protector can also be configured such that, for example, the rated voltage of the second polymer PTC element is set to at least 48V, the nominal resistance value is set to be either equivalent to or ½ or less than the load resistance, the voltage at both ends after the current interruption is set to 30V and more preferably 24V or less, the rated voltage of the first polymer PTC element is set to be within the range of the second polymer PTC element, and the current is passed through the second and third terminals to allow the first polymer PTC element to forcibly enter the trip state, the bimetal element to perform an inverting operation, the direct current between the first and second terminals to be interrupted, and the bimetal element to be prevented from recovering at the heating temperature of the second polymer PTC element after the interruption, thereby maintaining the interrupted state.

The external operation thermal protector can also be configured such that, for example, the first and third terminals are connected externally to the body casing to allow the second polymer PTC element to be connected parallel to the first polymer PTC element, and the combined resistance of the first and second polymer PTC element is reduced, thereby realizing a self-sustaining function of interrupting a current at a higher direct voltage.

The present invention can provide an external operation thermal protector having largely improved security in maintaining the operation state at a constant temperature by safely containing the resistance element of a polymer PTC element without a hot spot and operating a bimetallic protector using the heat of the resistance element.

REFERENCE NUMERALS

Figure 1A:
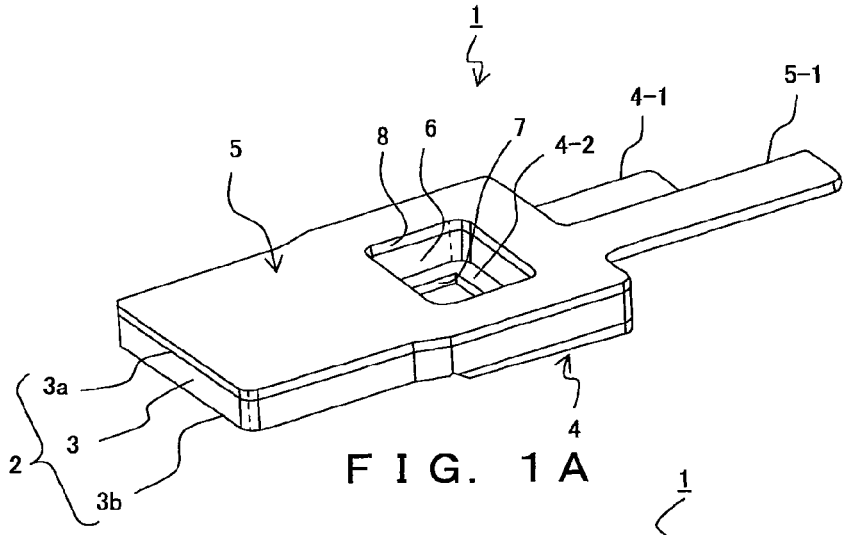
FIG. 1A is a perspective view of a resistance element module used for the external operation thermal protector according to embodiment 1.

1 resistance element module
2 resistance element (polymer PTC element)
3 inner resistance element
3*a*, 3*b* electrode foil
4 first terminal plate
4-1 first connection unit
4-2 periphery of a small-diameter hole
5 second terminal plate
5-1 second connection unit (third terminal)
6 hole
7 small-diameter hole
8 hole larger than the small-diameter hole
10 external operation thermal protector
11 box-shaped case
12 insulating filling member
13 body casing
14 bimetal
15 movable plate
15-1 nail portion
16 movable contact point
17 second terminal
17-1 fixed portion
18 fixed contact point
19 insulating column member
19-1 upper caulking unit
21 external connection wiring
22 fixed conductor
23 first terminal
24 external connection wiring
25 wiring
29 external operation thermal protector (protector)
30 second resistance element module
31 inner resistance element
31*a*, 31*b* electrode foil
32 second polymer PTC element
33 third terminal plate
33-1 third connection unit
33-2 periphery of a small-diameter hole
34 fourth terminal plate
34-1 fourth connection unit
34-2 first terminal
35 hole
35*b* hole
36 rectangular hole
37 column
37-1 lower portion
38 fixed contact point
39 external wiring

BEST MODE FOR CARRYING OUT THE INVENTION

The embodiments of the present invention are described below in detail with reference to the attached drawings.

Embodiment 1

Figure 1B:
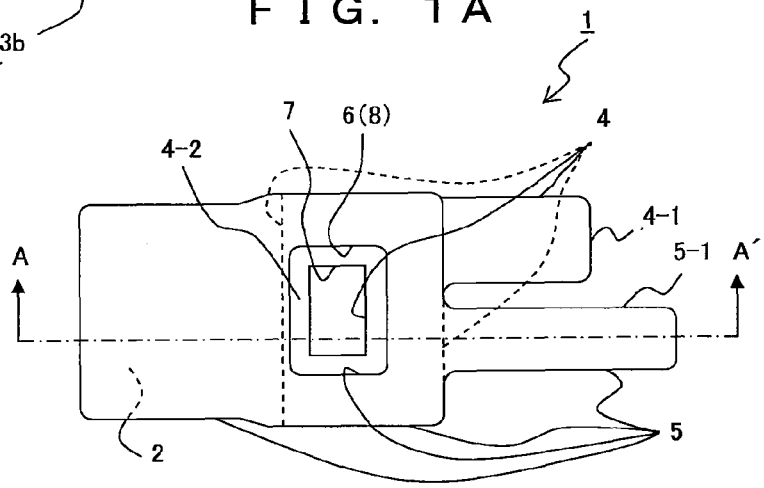
FIG. 1B is a plan view of FIG. 1A.
Figure 1C:
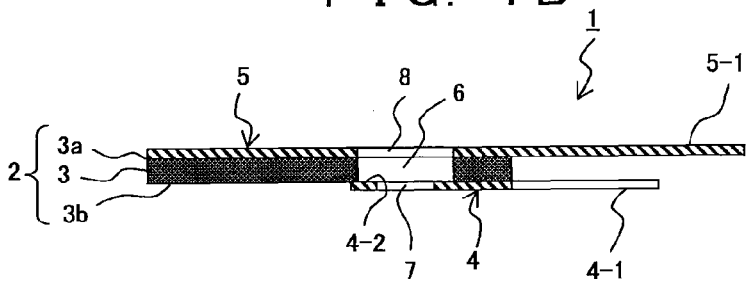
FIG. 1C is a sectional view from the viewpoint of the arrows along A-A' of FIG. 1B.

FIG. 1A is a perspective view of a resistance element module used for the external operation thermal protector according to embodiment 1. FIG. 1B is a plan view of FIG. 1A. FIG. 1C is a sectional view from the viewpoint of the arrows along A-A' of FIG. 1B.

A resistance element module 1 illustrated in FIGS. 1A, 1B, and 1C is configured by a polymer PTC element 2, a first terminal plate 4, and a second terminal plate 5.

In the present embodiment, the polymer PTC element 2 as a resistance element is configured by an inner resistance element 3 and thin electrode foils 3*a* and 3*b* attached to the upper and lower surfaces of the inner resistance element 3, and is formed completely as a plate element.

The first terminal plate 4 is soldered to one electrode foil 3*b* of the upper and lower electrodes of the inner resistance element 3. On the first terminal plate 4, a first connection unit 4-1 is formed as incorporated with the first terminal plate 4, extending parallel to the surface of the electrode foil 3*b* of the inner resistance element 3, and being longer than the inner resistance element 3.

The second terminal plate 5 is soldered to the other electrode foil 3*a* of the inner resistance element 3. On the second terminal plate 5, a second connection unit 5-1 is formed as incorporated with the second terminal plate 5, extending parallel to the surface of the electrode foil 3*a* of the inner resistance element 3, and being longer than the inner resistance element 3.

A hole 6 through the inner resistance element 3 and the electrode foils 3*a* and 3*b* on both surfaces of the inner resistance element 3 is formed in the plate-shaped polymer PTC element 2 in the direction of the thickness of the plate element. The hole 6 is substantially rectangular as illustrated in the figures, but the hole 6 can be circular, triangular, or a shape of any polygon in addition to a rectangle. That is, the shape of the hole 6 is not restricted.

In FIGS. 1A, 1B, and 1C, the first terminal plate 4 has a small-diameter hole 7 having a diameter smaller than the hole 6 at the position where the holes overlap. The first terminal plate 4 is fixed, as connected with the second terminal for external connection, to the fixed end of the movable plate described later by caulking the periphery 4-2 of a small-diameter hole that is smaller than the hole 6 and transforming the upper portion of the column.

That is, when the resistance element module 1 is incorporated into the body casing of the external operation thermal protector as an element of the external operation thermal protector described later, the entire resistance element module 1 is supported by the body casing through the fixed end of the movable plate.

The second terminal plate 5 has a hole 8, the diameter of which being equal to or larger than the diameter of the hole 6, and the hole 8 and the hole 6 are overlapped. The second connection unit 5-1 forms the third terminal for external connection when the resistance element module 1 is incorporated into the body casing of the external operation thermal protector described later as an element of the external operation thermal protector.

Figure 2A:
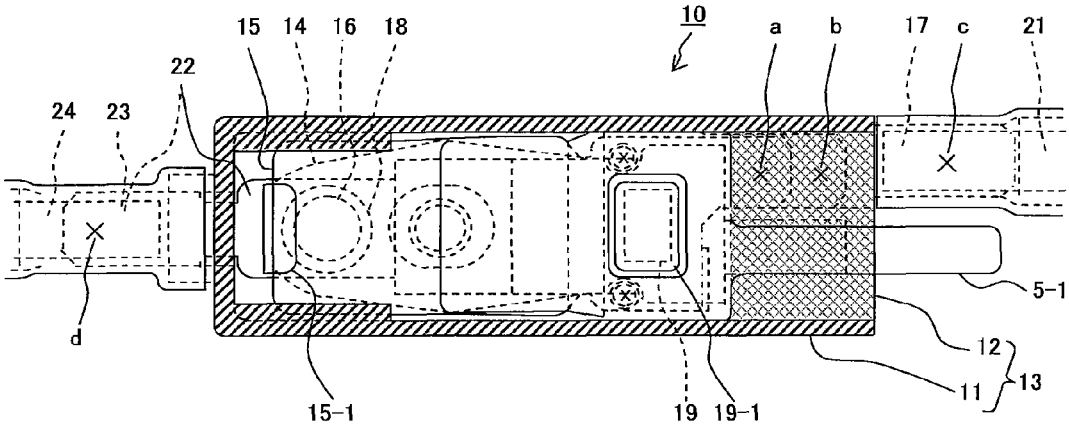
FIG. 2A is a perspective plan view of the external operation thermal protector according to embodiment 1, completed by incorporating a resistance element module into the body casing.

FIG. 2A is a perspective plan view of the state in which the external operation thermal protector according to the present embodiment is completed by incorporating the resistance element module 1 configured by the polymer PTC element 2, the first terminal plate 4, and the second terminal plate 5 into the body casing of the external operation thermal protector.

Figure 2B:
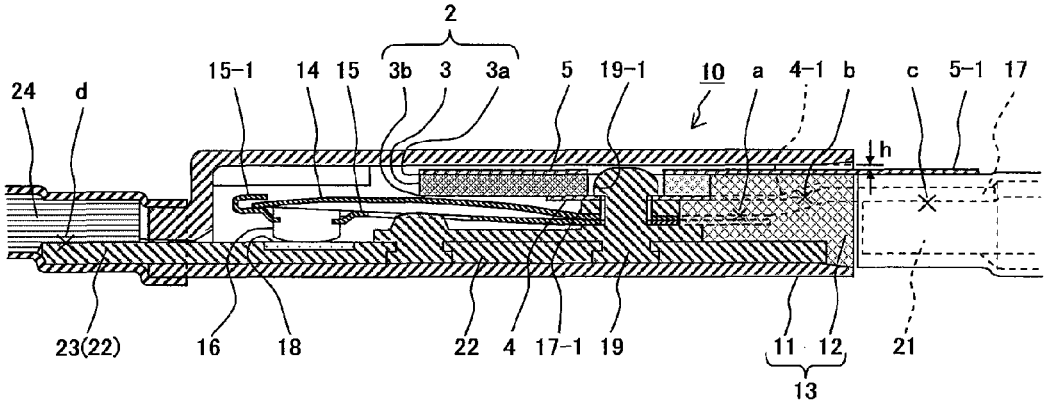
FIG. 2B is a side sectional view of FIG. 2A.
Figure 2C:
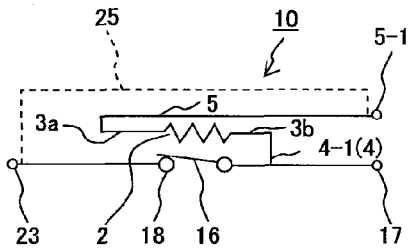
FIG. 2C is a view of the circuit wiring of the external operation thermal protector illustrated in FIGS. 2A and 2B.

FIG. 2B is a side sectional view of FIG. 2A. FIG. 2C is a view of the circuit wiring of the external operation thermal protector illustrated in FIGS. 2A and 2B.

In FIGS. 2A and 2B, the same components as those illustrated in FIGS. 1A, 1B, and 1C are assigned the same reference numerals.

An external operation thermal protector 10 (hereinafter referred to simply as a protector 10) illustrated in FIG. 2B includes a body casing 13 configured by a box-shaped case 11 and an insulating filling member 12 for sealing the aperture (right end in FIG. 2B) of the box-shaped case 11. The body casing 13 includes a bimetal 14 as a thermal reactive element that performs a reversing operation at a predetermined temperature, and a conductive movable plate 15.

The movable plate 15 holds a movable contact point 16 on the free end side (on the left in FIG. 2B), and a nail portion 15-1 is formed at the end of the free end. The movable plate 15 has a spring property for allowing the movable contact point 16 to have a predetermined contact pressure at a contact point, and presses the movable contact point 16 toward a fixed contact point 18 with a predetermined contact pressure at a contact point, as illustrated in FIG. 2B, in the normal state.

On the other bimetal 14, an upper caulking unit 19-1 of the insulating column member 19 is caulked via transformation by caulking at one end (end portion on the right in FIG. 2B) together with the fixed end of the movable plate 15 through a fixed portion 17-1 of the second terminal 17 and the first terminal plate 4 of the resistance element module 1 (FIGS. 1A, 1B, and 1C), and is fixed to the bottom of the body casing 13.

Thus, the fixed end of the movable plate 15 and the first terminal plate 4 of the resistance element module 1 (that is, the lower electrode foil 3*b* of the polymer PTC element 2) are connected to the second terminal 17.

Then, the other end (left end in FIG. 2B) is engaged in the nail portion 15-1 of the movable plate 15. Thus, the movable plate 15 can operate at any time by cooperating with the inverting operation of the bimetal 14.

At the upper portion on the fixed end side, substantially above the central portion of the bimetal 14, the polymer PTC element 2 whose lower electrode foil 3*b* of the resistance element module 1 is exposed is arranged closely.

Thus, when the polymer PTC element 2 of the resistance element module 1 generates heat, the generated heat is transferred by the thermal conductivity to the fixed end of the bimetal 14 through the first terminal plate 4 and the fixed portion 17-1 of the second terminal 17, and the heat is further transferred by the radiation and circulation in the body casing 13 to substantially one half of the fixed end of the bimetal 14, thereby efficiently transferring heat to the bimetal 14 as a whole.

In the present embodiment, the trip temperature at which the resistance of the inner resistance element 3 of the polymer PTC element 2 suddenly changes is set to be higher than the temperature of the inverting operation of the bimetal 14.

As described above, the lower first terminal plate 4 of the resistance element module 1 is caulked and fixed at the bottom of the body casing 13 and fixed at the bottom of the body casing 13. Then, a gap h is formed between the upper surface of the upper second terminal plate 5 of the resistance element module 1 and the upper inner wall surface of the body casing 13. The gap is provided for absorbing the volume expansion by the heat generated by the polymer PTC element 2.

In addition, the second connection unit 5-1 extended from the second terminal plate 5 as described above forms the third terminal as an external connection unit externally to the body casing 13. That is, the electrode foil 3*a* at the upper part of the resistance element module 1 is connected to the second connection unit 5-1.

In FIGS. 2A and 2B, the x marks labeled a, b, and c respectively indicate the weld between the movable plate connection terminal unit and the second terminal 17, a weld between the first connection unit 4-1 and the second terminal 17, and a weld between the second terminal 17 and external connection wiring 21. With this configuration, each connection can be ensured.

Furthermore, a fixed conductor 22 provided with the above-mentioned fixed contact point 18 is positioned by the insulating column member 19 and fixed and arranged at one end in the body casing 13 at the bottom of the body casing 13. The end portion provided with the fixed contact point 18 of the fixed conductor 22 is extended externally to the body casing 13 to form a first terminal 23 for connection to the external circuit.

The x mark labeled d illustrated in interface 2A and 2B indicates a weld between the first terminal 23 and external connection wiring 24. Thus, the connection between them is ensured.

In the protector 10 with the above-mentioned configuration illustrated in FIGS. 2A, 2B, and 2C, when a sufficient current is applied externally to the second connection unit 5-1 and the second terminal 17 in the external operation, the polymer PTC element 2 forcibly generates heat, then enters a trip state, and hereafter maintains a high constant temperature with a low current.

Since the temperature is set to be higher than the temperature at which the bimetal 14 is inverted, the bimetal 14 is heated and inverted. In cooperation with the inverting operation, the free end of the movable plate 15 moves upward, and the movable contact point 16 is detached from the fixed contact point 18 and releases the contact point. Thus, the interrupt operation for interrupting the power supply between the first terminal 23 and the second terminal 17 is completed.

When the power is continuously supplied to the polymer PTC element 2, the bimetal 14 continues the heating state, thereby maintaining the interrupted state. In this case, unlike a self-sustaining protector whose resistance element is connected parallel to the contact point circuit, there is no leakage current to the contact point circuit even though the self-sustaining state is maintained, thereby maintaining the interruption in the complete interrupted state.

When the temperature at which the resistance of the polymer PTC element 2 suddenly changes and generates heat is set to be lower than the operation temperature of the bimetal 14, the protector does not operate even though the polymer PTC element 2 has an external power supply and generates heat at a predetermined temperature.

In addition, since the time for current interruption by a protector changes with the ambient temperature, it is difficult to regulate the operation characteristics of a circuit breaker, an overload protection device, etc., which are required within a predetermined time with overcurrent.

The operation time is longer when the ambient temperature is lower, and a hazardous state can be anticipated. When the ambient temperature is low, the polymer PTC element 2 is energized to keep the inside of the protector at a predetermined high temperature so that the operation time can be adjusted in accordance with the operation condition when the ambient temperature is relatively high.

Variation example of Embodiment 1

With the configuration illustrated in FIGS. 2A, 2B, and 2C, a common self-sustaining protector having a resistance element parallel to a contact point circuit can also be realized by connecting the first terminal 23 to the second connection unit 5-1 via wiring 25 outside the protector as illustrated in FIG. 2C.

Embodiment 2

Figure 3A:
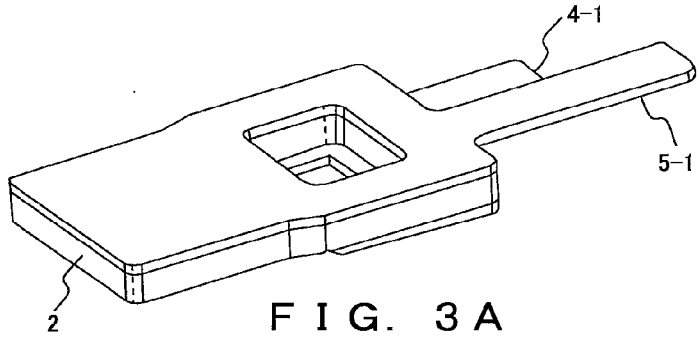
FIG. 3A is a perspective view of the first resistance element module used in the external operation thermal protector according to embodiment 2.
Figure 3B:
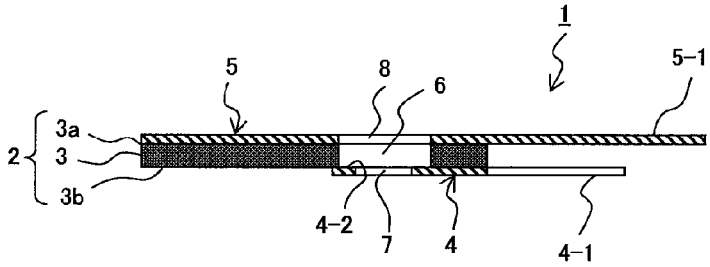
FIG. 3B is a side sectional view of FIG. 3A.
Figure 3C:
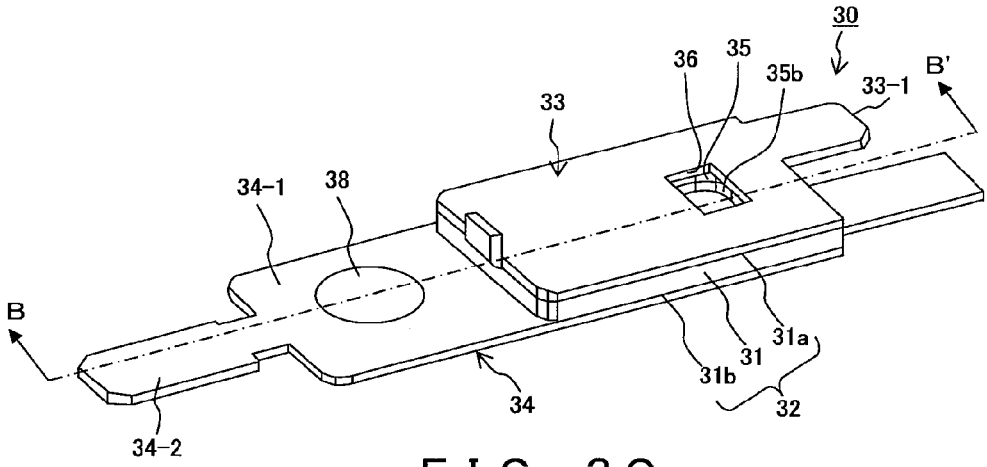
FIG. 3C is a perspective view of the second resistance element module.
Figure 3D:
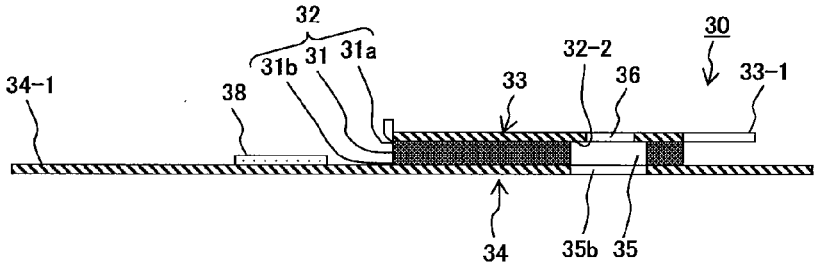
FIG. 3D is a sectional view from the viewpoint of the arrows along B-B' of FIG. 3C.

FIGS. 3A and 3B illustrate the first resistance element module used for the external operation thermal protector according to embodiment 2, and re-illustrate FIGS. 1A and 1C. FIG. 3C is a perspective view of the second resistance element module used for the external operation thermal protector according to embodiment 2, and FIG. 3D is a sectional view from the viewpoint of the arrows along B-B' of FIG. 3C.

Figure 4A:
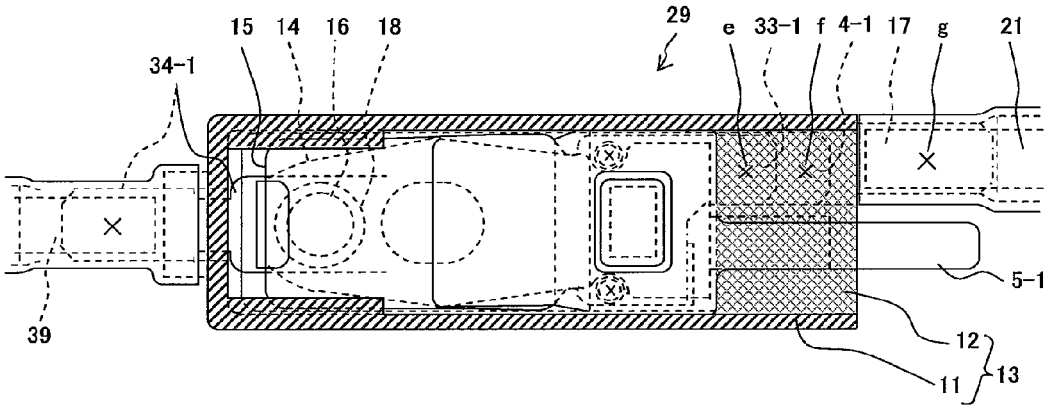
FIG. 4A is a perspective plan view of the external operation thermal protector according to embodiment 2, completed by incorporating two resistance element modules into the body casing.
Figure 4B:
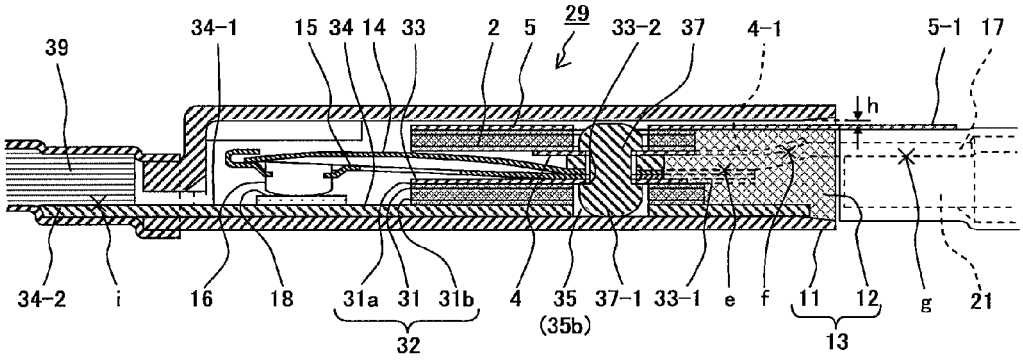
FIG. 4B is a side sectional view of FIG. 4A.
Figure 4C:
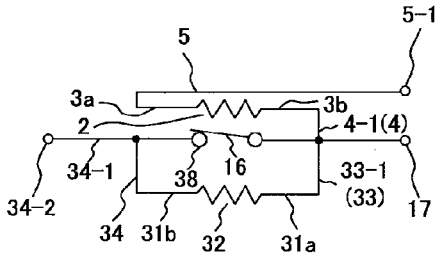
FIG. 4C is a view of the circuit wiring of the external operation thermal protector illustrated in FIGS. 4A and 4B.

FIG. 4A is a perspective plan view of an external operation thermal protector 29 (hereinafter referred to simply as a protector 29) according to embodiment 2, completed by incorporating two resistance element modules into the body casing. FIG. 4B is a side sectional view of the protector. FIG. 4C is a view of the circuit wiring of the protector.

The same components illustrated in FIGS. 3A, 3B, 4A, 4B, and 4C as those illustrated in FIGS. 1A, 1B, 1C, 2A, 2B, and 2C are assigned the same reference numerals as those in FIGS. 1A, 1B, 1C, 2A, 2B, and 2C.

In the present embodiment, as illustrated in FIGS. 3A and 3B, the resistance element module 1 illustrated in FIGS. 1A and 1B is used as the first resistance element module having the first polymer PTC element.

Therefore, in the present embodiment, the reference numerals of only the necessary portions of the first resistance element module are illustrated again without detailed description, and a second resistance element module 30 having the second polymer PTC element is described below.

As illustrated in FIGS. 3C, 3D, 4A, 4B, and 4C, the second resistance element module 30 includes an inner resistance element 31, and a second polymer PTC element 32 having electrode foils 31*a* and 31*b* on both sides of the inner resistance element 31.

Furthermore, the second resistance element module 30 includes a third terminal plate 33 and a fourth terminal plate 34 respectively soldered to the electrode foils 31*a* and 31*b* on both sides of the second polymer PTC element 32, and a third connection unit 33-1 and a fourth connection unit 34-1 extended as a unitary construction parallel to the surfaces of the electrode foils 31*a* and 31*b* from the third terminal plate 33 and the fourth terminal plate 34.

The plate-shaped second polymer PTC element 32 has a hole 35 through the inner resistance element 31 and the electrode foils 31*a* and 31*b* on both sides in the thickness direction of the plate element. The hole 35 can be, for example, rectangular, circular, or any polygon shape, and is not restricted in shape.

In FIGS. 3C and 3D, the fourth terminal plate 34 has a hole 35*b* having a diameter equal to or larger than the hole 35 at the position where it overlaps the hole 35. The third terminal plate 33 has a rectangular hole 36 having a diameter smaller than the hole 35 at the position where it overlaps the hole 35.

The third terminal plate 33 is connected and fixed to the lower portion of the fixed end of the movable plate 15, as illustrated in FIG. 4B, when the second resistance element module 30 is incorporated into the body casing 13 of the protector 29 by transforming and caulking a periphery 33-2 of the hole 36 having a diameter smaller than the hole 35, which is done by caulking under part 37-1 of the column 37.

The fixed end of the movable plate 15 is connected to the second terminal 17 for external connection together with the first connection unit 4-1 of the resistance element module 1 (first resistance element module 1 of the present embodiment) as illustrated in FIG. 2B.

Therefore, the third terminal plate 33 of the second resistance element module 30 according to the present embodiment, that is, the electrode foil 31*a* of the second polymer PTC element 32, is connected to the first connection unit 4-1 of the first resistance element module 1, that is, the electrode foil 3*b* of the first polymer PTC element 2, and the second terminal 17.

The x mark labeled e illustrated in FIG. 4B indicates the weld between the third connection unit 33-1 as an extended portion of the third terminal plate 33 and the second terminal 17. Thus, the connection between the third connection unit 33-1 and the second terminal 17 is ensured. The x marks labeled f and g on the right in FIG. 4B illustrated together with the x mark labeled e are the same as the x marks a, b, and c illustrated in FIG. 1B.

On the fourth connection unit 34-1, as the extended portion of the fourth terminal plate 34 of the second resistance element module 30, a fixed contact point 38 is formed at the position corresponding to the movable contact point 16 in the body casing 13.

The portion extended from the position at which the fixed contact point 38 of the fourth connection unit 34-1 is formed configures a first terminal 34-2 for external connection to external wiring 39 outside the body casing 13.

The x mark labeled i on the left in FIG. 4B indicates the weld between the first terminal 34-2 for the external wiring 39. Thus, the connection between the first terminal 34-2 and the external wiring 39 is ensured.

With the arrangement configuration in FIGS. 4A and 4B, the second terminal plate 5 is arranged with a gap h for absorbing the volume expansion caused by the heat of the first polymer PTC element 2 between the plate and the inner wall surface (upper inner wall surface) of the body casing 13, as described above with reference to FIG. 1B.

The fourth terminal plate 34 is arranged with a gap for absorbing the volume expansion caused by the heat of the second resistance element module 30 between the plate and the inner wall surface (lower inner wall surface) opposite the upper inner wall surface of the body casing 13, although this is not clearly shown in the figure.

In the present embodiment, the trip temperature at which the resistance of the first polymer PTC element 2 suddenly changes is set to be higher than the inverting operation temperature of the bimetal 14. The trip temperature at which the resistance of the second resistance element module 30 suddenly changes is set to be higher than the recovery temperature of the bimetal 14.

With this configuration, when a current is forcibly passed externally to the second terminal 17 and the second connection unit 5-1, the first polymer PTC element 2 forcibly enters the trip state, and heats the bimetal 14 for an inverting operation.

Thus, the power supply between the first terminal 34-2 and the second terminal 17 is interrupted. After the interruption of the current, the recovery of the bimetal 14 is prevented by the heating temperature of the second polymer PTC element 32, and the interrupted state of the current is maintained.

In the above-mentioned embodiments, since one terminal plate of the resistance element module is fixed to the fixed end of the movable plate, a column is used for fixing the plate by caulking. Thus, when the plate is fixed by caulking, a hole is to be made in the terminal plate which contacts the fixed end of the movable plate. However, the method of fixing the terminal plate is not limited to this application.

For example, when the terminal plate is jointed with the fixed end in a method such as resistance welding, laser welding, ultrasonic welding, etc., no hole is necessary, but only a guide portion for aligning the terminal plate with the fixed end of a movable plate is required. In these methods above, the protector 10 or 29 can be assembled.

According to the above-mentioned embodiment 2, a protector provided with two built-in resistance elements such as polymer PTC element passes a predetermined current between the second and third terminals to forcibly operate the protector and then stop the current between the second and third terminals so as to continue to maintain the self-sustaining state for current interruption between the first and second terminals. However, to maintain the current interruption, an electrical condition providing sufficient heat for the second polymer PTC element is required.

The creation of an interruption arc with the mechanical contact point in the voltage condition is a problem, especially with a relatively high direct current. When resistance elements such as the second polymer PTC element are connected in parallel at the contact point circuit, that is, between the first and second terminals, the voltage is divided by the parallel resistance between the load resistance and the resistance element, and a restriction is placed on the voltage at both ends of the parallel resistance between the contact points. Therefore, when a voltage lower than the discharge starting voltage is able to be maintained, the interrupt operation can be terminated without an occurrence of an interruption arc between the contact points.

These states depend on the power supply voltage and the load resistance. However, if the power supply voltage is around DC49V through DC60V, if the resistance of the first polymer PTC element is equal to or about half of the load resistance, and if the voltage at both ends of the second polymer PTC element after interruption can be maintained at lower than 30V or preferably lower than 24V, then a considerably large current can be interrupted.

After the contact point interruption, the immediately divided current and the current restricted by a resistance value are passed through the second polymer PTC element, and the second polymer PTC element instantly enters the trip state, thereby completing the interrupt operation.

If the third terminal is connected to the first terminal as a variation example of embodiment 2, the function of the external operation cannot be used, but the first and second polymer PTC elements can be connected in parallel. Therefore, the substantial nominal resistance value becomes smaller, and a larger current can be interrupted.

The interruption can be attained because the partial pressure on the PTC element side can be smaller with a larger current if the load resistance is small when the resistance on the PTC element side becomes smaller, thereby easily keeping the voltage lower than the discharge starting voltage between the contact points.

As described above, according to the protector of the present invention, a polymer PTC element can be safely incorporated with one terminal leading outside the protector for an external operation, with the following operations and effects.

First, unlike the safety assurances attained by an automatic operation, intentional protection using a circuit and software can be realized, thereby ensuring a safer operation.

Second, after the intentional operation, the operation state can be easily maintained, and the system can be reused when a fault is able to be removed.

Third, the operation of interrupting a large current can be performed at a voltage with a relatively high direct current, and the safety of a power system using a storage battery in late years can be effectively guaranteed.

Fourth, various uses can be realized at the trip temperature and the operation temperature of a bimetal.

Fifth, various uses can be realized by appropriately connecting the third external connection terminal.

The invention claimed is:

1. An external operation thermal protector which interrupts an electric circuit using a bimetal element whose warping direction is inverted at a predetermined temperature in reaction to an ambient temperature, comprising:

a body casing;

a fixed conductor having a fixed contact point at one end;

a first terminal formed at an end of the fixed conductor for connection to an external circuit external to the body casing;

a movable plate having a movable contact point at a position opposite the fixed contact point on a free end side, having a spring property for allowing the movable contact point to have a predetermined contact pressure at a contact point, being fixed to the body casing at an end opposite the free end side through an insulating member, and changing a position of the free end side by inversion of the bimetal element;

a second terminal connected to the movable plate for external connection;

a resistance element module having a polymer PTC element provided with an inner resistance element and electrodes on both surfaces of the inner resistance element, first and second terminal plates soldered to the electrodes on both sides of the polymer PTC element, and first and second connection units laid together after being extended parallel to electrode surfaces from the first and second terminal plates, having the first connection unit connected to the second terminal at an end opposite the free end of the movable plate, and having the first terminal plate fixed to the body casing through the movable plate and the insulating member; and a third terminal formed by the second connection unit of the resistance element module for external connection external to the body casing, wherein;

a gap for absorbing volume expansion by heat generated by the polymer PTC element is provided between the upper surface of the second terminal plate and an inner wall of the body casing;

the trip temperature at which the resistance of the polymer PTC element suddenly changes is set to be higher than the inversion operation temperature of the bimetal element; and when a current is led to the second and third terminals, the polymer PTC element forcibly enters the trip state, and heats and operates the bimetal element, thereby interrupting the current between the first and second terminals.

2. The protector according to claim 1, wherein the polymer PTC element is heated at a predetermined temperature by maintaining the current to the second and third terminals after interrupting the current between the first and second terminals, and the current interrupt operation is continuously maintained between the first and second terminals.

3. The protector according to claim 1, wherein:

a trip temperature at which the resistance of the polymer PTC element suddenly changes is set to be lower than the operation temperature of the bimetal element;

a current is passed to the second and third terminals to heat the bimetal element at a constant temperature with the polymer PTC element being forcibly placed in the trip state, thereby correcting the characteristic of the current and time for protection against overloading in the low temperature atmosphere for the interrupt operation, with the overcurrent passing between the first and second terminals.

4. The protector according to claim 1, wherein a self-sustaining operation is performed when the interrupt operation is performed between the first and second terminals when there is overheating or overcurrent by additionally connecting the polymer PTC element parallel to an inner contact point circuit between the first and second terminals by connecting the first and third terminals externally to the body casing.

* * * * *

UNITED STATES PATENT AND TRADEMARK OFFICE

CERTIFICATE OF CORRECTION

PATENT NO. : 8,519,816 B2
APPLICATION NO. : 12/933202
DATED : August 27, 2013
INVENTOR(S) : Hideaki Takeda It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 212 days.

Signed and Sealed this
Fifteenth Day of September, 2015

Michelle K. Lee

Michelle K. Lee
*Director of the United States Patent and Trademark Office*